United States Patent [19]

DeLuca

[11] Patent Number: 4,810,430

[45] Date of Patent: Mar. 7, 1989

[54] DEFORMABLE PULP PAPER PRODUCT, ITS METHOD OF MANUFACTURE AND METHOD OF USE

[76] Inventor: Peter L. DeLuca, 43500 Old Harbour Dr., Bermuda Dunes, Calif. 92201

[21] Appl. No.: 74,674

[22] Filed: Jul. 17, 1987

[51] Int. Cl.[4] ..... C06B 21/00

[52] U.S. Cl. ..... 264/3.3; 264/3.5

[58] Field of Search ..... 264/3.2, 3.3, 3.5

[56] References Cited

U.S. PATENT DOCUMENTS

| | | | |
|---|---|---|---|
| 2,326,758 | 8/1943 | Chaplin et al. | 92/56 |
| 2,429,431 | 10/1947 | Sloan | 92/55 |
| 2,947,254 | 8/1960 | Weiss | 102/43 |
| 2,991,168 | 7/1961 | Nadel | 52/5 |
| 3,140,638 | 7/1964 | DeLuca | 89/1.7 |
| 3,250,839 | 5/1966 | DeLuca | 264/119 |
| 3,320,886 | 5/1967 | DeLuca | 102/43 |
| 3,444,812 | 5/1969 | Gawlick et al. | 102/39 |
| 3,474,702 | 10/1969 | Remaly et al. | 86/1 |
| 3,608,421 | 9/1971 | Gibbon et al. | 86/1 |
| 4,159,678 | 7/1979 | Luther et al. | 102/44 |
| 4,267,132 | 5/1981 | Henderson et al. | 264/3.2 |
| 4,649,823 | 3/1987 | Bell | 102/289 |

OTHER PUBLICATIONS

DeLuca & Williams, Fibrillated Fiber in Combustible Cartridge Cases; 1 & EC Product Research & Deul, vol. 23, pp. 438–441 (1984).

DeLuca & Williams, Molded Fiber Products, Encyclopedia of Materials Science & Eng. pp. 3090–3092, Pergaman Press, 1986.

*Primary Examiner*—Peter A. Nelson

*Attorney, Agent, or Firm*—Birch, Stewart, Kolasch & Birch

[57] ABSTRACT

A deformable molded fiber product is formed by a method of felting, pressing and drying the compressed product having a uniformly spaced series of low density ridges on one surface. These ridges provide the molded fiber product with sufficient flexibility so that is may be subjected to a hot swaging like process to change its dimensions. A method of forming detents by hot pressing is also shown. The process is particularly useful in forming combustible nitrocellulose shell casings from a single pulp molding operation.

30 Claims, 5 Drawing Sheets

DEFORMABLE PULP PAPER PRODUCT, ITS METHOD OF MANUFACTURE AND METHOD OF USE

BACKGROUND OF THE INVENTION

1. Field Of The Invention

The present invention relates to a method and apparatus for making a polymer resin impregnated, deformable molded fiber product, and a method of deforming the product. In particular, the present invention relates to a method of making a combustible, nitrocellulose shell casing from a single molding by forming the casing from a unique intermediate pulp product which can be swaged to form a reduced diameter. The invention further includes a method of forming detents in the casing by hot pressing permitting the easy attachment of a metal stub base.

2. Description Of The Background Art

Combustible shell casings have been in use as ammunition for tank guns, self-propelled Howitzers and as other ordinance items for some time. It is known to form these casings from mixtures of nitrocellulose fiber, natural cellulose fiber and synthetic fiber. This fiber mixture is accreted from a slurry on a felting die, pressed and dried in vented, mated, drying dies under vacuum to close tolerances to fit the firing chamber of a gun.

Combustible cartridge cases not only contain the main propellant charge, but contribute to its ballistic properties as well. Upon firing, the cases are consumed, leaving no smoldering residue. The use of these combustible cases saves metal, reduces the hazards of spent casings, eliminates the disposal of spent cases and simplifies automatic firing equipment. It is particularly advantageous to avoid spent cases after firing when space is limited such as in the close quarters of a tank.

Various methods and apparatus for forming combustible ordinance items are known in the prior art and described in U.S. Pat. No. 3,320,886. By that method combustible cartridge cases have been made by accreting nitrocellulose fibers and other cellulose fibers from an aqueous suspension onto a porous felting die or preformer, removing excess moisture and then placing the formed felted product in a die-dry press between a male and female die. The felted product was then compressed and die dried between these heated dies at a temperature not exceeding 250° F. The resultant die dried article was then impregnated with a solvent solution of a resin, and cured.

The prior art process of making the combustible cartridge required molding two separate parts which were then assembled to form the cartridge. Such additional handling of the article can increase cost and increase the danger of explosion as the article must be handled a plurality of times.

The forming and assembly of two separate parts is a serious problem with the prior art technique. One end of a finished shell casing is usually completely or partially closed and the other end is shaped to a reduced diameter to facilitate the attachment of a metal stub base. Such a reduced diameter shape amounts to an undercut or a backdraft of the casing. Such a shape cannot be formed by pulp molding techniques because the formed product can not be removed from the male die. To avoid this impasse, the prior art forms at least two molded fiber parts, a top or cap and a bottom, which are later joined by gluing, strapping or the like.

Creating the joint requires careful lathe cutting of this highly flammable product. This is a dangerous procedure.

Accordingly, a need exists in the art for a simple and economical method and apparatus for manufacturing a combustible cartridge case or the like with a single molding. Furthermore, a need exists in the art for a single molded fiber product which can readily receive a metal stub base and for a tool which can form such a product.

SUMMARY OF THE INVENTION

Accordingly, it is a primary object of the invention to provide a method and apparatus for economically manufacturing cylindrical pulp products having undercuts, closures or reduced diameters at each end.

It is another object of this invention to form the products out of a nitrocellulose containing fibrous pulp.

It is a further object of the present invention to avoid excessive handling of the product during formation of a product in the form of a shell casing.

It is yet a further object of the invention to provide a method of forming a shell casing by molded fiber technology as one piece and subsequently forming areas of reduced diameters.

An additional object of the present invention involves forming a hollow cylindrical molded fiber product which has generally equidistant spaced ridges positioned thereon which ridges may be collapsed to permit the swaging of said paper product.

Yet another object of the present invention is to provide a tool for the swaging of a hollow cylindrical molded fiber product having uniformly spaced areas of reduced density.

Still a further object of the present invention is to provide a new and improved process for making a combustible cartridge case which is more practical and economical than known processes and which uses fewer parts.

These and other objects of the present invention are fulfilled by providing a method of first forming a deformable molded fiber product which can be in the form of a shell casing by the steps of felting a slurry comprising a mixture of a thermoplastic polymer resin and cellulosic fibers on a preformer by known methods. Second, the felted wet preform formed on the preformer is mounted on a male die, enclosed by the mating die, pressed and dried. Subsequently, this compressed casing is shaped by swaging and further processed to provide attachment means for metal parts, such as a stub base.

The thermoplastic polymer resins employed in this invention are those which are normally hard at temperatures usually experienced by human beings and their equipment in such environments as the Arctic and desert regions. These thermoplastic polymer resins must have a softening point which is less than the flash or combustion point of the most degradable of the fibers in the molded fiber product. For shell casings, the slurry further contains nitrocellulose fibers and other fibers which may all be the same or a mixture derived from both natural and synthetic sources. For other products, the slurry does not contain nitrocellulose. The specific formulations are known in the art.

In the second step of the method, the felted preform casing is removed from the preformer and placed between male and female drying dies mounted in a press.

Although the structure and mode of operation of the dies and press are well known in the art, the dies in this invention are modified to impart the structures necessary for the practice of this invention.

To produce a deformable molded fiber product, either the male or female die of a die dry press contains a series of equally spaced groves. Although the prior art male or female dies contain several grooves to which vacuum can be applied to suck off the excess fluids from the felted casing while it is being pressed, the grooves used to produce the present invention are larger and more numerous.

In the prior art the ordinary grooves are usually covered with a screen or grid work to give a uniform surface to the final product. Often workers will omit this screen and, as a consequence, groove marks in the form of ridges will be formed on the surface of the product. Some prior art such as U.S. Pat. No. 2,326,758, teach methods of removing these groove marks by opening the press part way through the pressing operation and rotating the product. This same patent teaches the use of the ridges formed on the preform for other purposes such as holding thread, and U.S. Pat. No. 3,250,839 teaches using ridges to form fracture lines in a molded fiber product.

Contrary to the prior art, this invention has found that forming uniformly, specifically spaced ridges on at least one surface of the molded fiber product creates a deformable product capable of deformation into additional forms under circumstances that would cause an ordinary die dried molded fiber product to flake, delaminate, crack, fold or bend.

The polymer resins useful in forming the slurry of this invention are such polymers as water dispersed polyurethane, polystyrene-butadiene, polyvinylacetate and polyacrylates, including such compositions as are described in U.S. Pat. No. 3,406,139. The thermoplastic polymer resins are added to the cellulose fiber in what is well known as the beater treatment process. The final die dried product is a polymer resin impregnated molded fiber product.

In the subsequent preferred steps, the deformable casing is mounted in a swaging tool and swaged to form a reduced diameter. Following swaging the casing is provided with detents by a hot pressing technique in a detent press which is also a part of this invention.

In a preferred method of this invention the pulp slurry comprises a mixture of nitrocellulose fiber, Southern Kraft fiber and at least one of the thermoplastic polymer resins prepared as described in U.S. Pat. Nos. 3,406,139, col. 19, line 64 et seq., 3,474,702, or 2,991,168, Example III. Normally the molded product formed with these thermoplastic resins will remain relatively hard or rigid up to a temperature of at least 150° F. This molded fiber product will be deformable at temperatures approaching but below 250° F.

The end product of this first forming step, a formed compressed molded fiber product having equally spaced ridges, is itself a unique product useful for forming other products. In the preferred embodiment, this end product has uniformly spaced longitudinal ridges on the inner surface where the ridges are areas of low density formed at 10° on center or less than 10° on center. The compressed casing is open at at least one end. It can be shaped or closed at the other end.

The swaging tool has a die for shaping the molded pulp product, a clamping mechanism to hold the molded pulp product and a driving means to force or drive the pulp product into the heated swaging die. It is not necessary to support the entire formed pulp product but only that portion against which pressure is being applied. The swaging die is heated to a temperature above the softening point of the thermoplastic polymer resin and below the flash point of nitrocellulose. This means below 250° F.

The molded product is driven into the swaging die at a rate sufficient to allow the heat of the die to soften the immediate area coming in contact with the die. It is preferred that this rate be approximately 5 mm per second for the polymer resins described above.

The swaging tool is also a part of this invention. It permits the formation of an area of reduced diameter for whatever distance the molded fiber product is driven or forced into the swaging die. The swaging tool which contains the swaging die, also forms the appropriate chamfer, dependent on the shape of the die, between the area of reduced diameter and the area of original diameter. Of course, if the ridges are formed on the outside of the cylinder the molded fiber product can be swaged onto a flair or an area of increased diameter.

A nitrocellulose molded fiber shell casing requires some form of metal stub base to attach the firing mechanism to the shell casing. The most efficient means of attaching a stub base to the shell casing is the use of detents. These detents can be one continuous detent totally encompassing the circumference of the reduced area of the casing or a series of button detents equally spaced about the circumference of the reduced area. When press fit into the metal stub base, these detents match with the appropriately placed receiver(s) in the metal stub base and thereby lock the metal stub base to the shell casing.

The detent can be formed in the reduced area of the molded nitrocellulose fiber product by a tool which is also part of this invention. To form the detent, the reduced diameter is placed into a die which contains a cavity for the detent. A first pressure plate means having a diameter slightly less than the inside diameter of the molded compressed fiber product is inserted into the opening. A deformable resilient material is then placed into the opening and the opening closed by a second pressure plate mechanism which can include the bench top. A force is applied on the first pressure plate means causing it to compress the deformable material against the second pressure plate means. This pressure causes the deformable material to spread, pressing the casing wall into the appropriate cavity thereby forming the detent. The deformable material is preferably 40 to 50 shore durometer neoprene rubber.

The female die can be a split die which is heated to a temperature of 250° F. in a manner similar to the manner in which the swaging die is heated. Alternaely a ring with slideable dies can be used to form the detents. When the detents are formed and the casing withdrawn from the die, the dies which formed the detents slide out with the casing and fall away, leaving the detents. This die is also heated in the manner described before.

By the use of the swaging technique the nitrocellulose molded fiber product can be formed as one piece and the two piece construction required by the prior art can be eliminated. With the simple attachment of the metal stub base by detents, the number of parts needed to assemble the shell casing can be reduced.

The further scope and applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not to be read as limiting the present invention, and wherein.

DETAILED DESCRIPTIONS OF THE PREFERRED EMBODIMENTS

Figure 1:
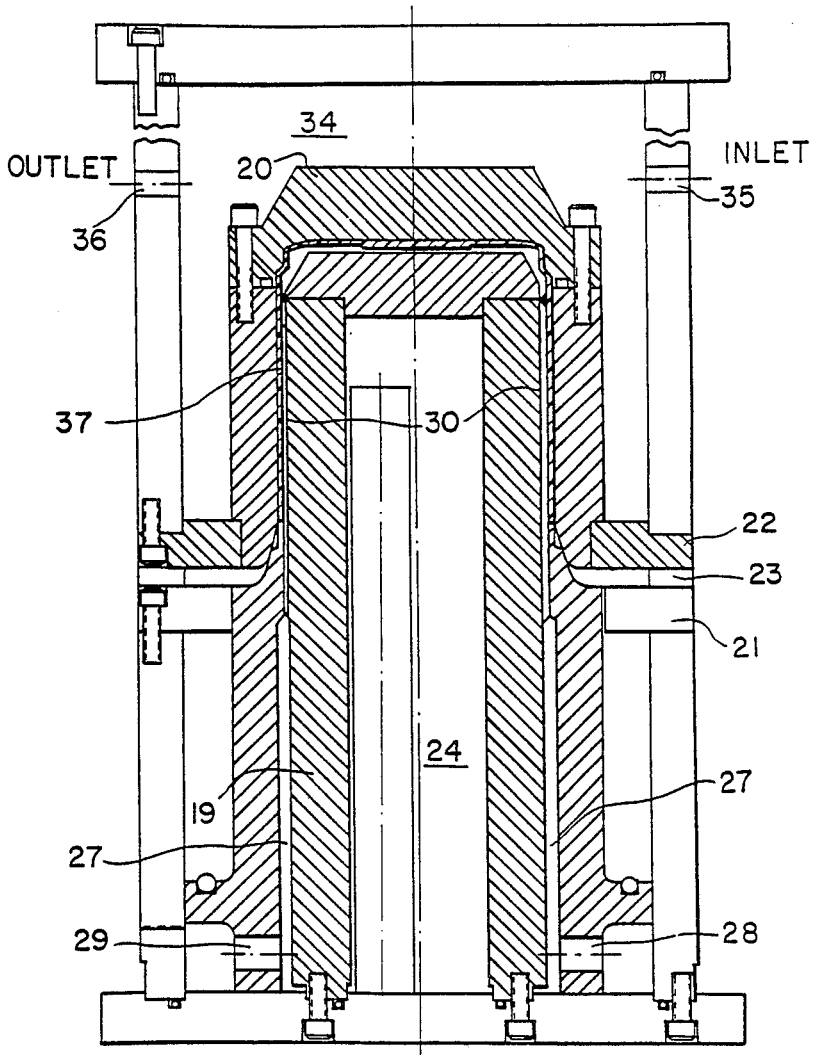
FIG. 1 is a cross-sectional view of mated drying dies mounted in a press apparatus which can be employed in manufacturing a shell casing of the invention.

Referring in detail to the drawings and with particular reference to FIG. 1, a conventional die drying apparatus for forming a shell casing is disclosed which has been modified to produce the instant invention. This apparatus includes a male die 19 and a female die 20. These dies have flanges 21 and 22, respectively, which are separated from each other when the dies are closed by a vacuum ring 23.

The male die 19 is provided with a heating chamber 24 into which steam, hot oil, or other suitable heat exchange medium can be introduced through an inlet and withdrawn through an outlet, both not shown. The male die 19 is also provided with an annular vacuum chamber 27 which is connected by pipes 28 and 29 to a suitable vacuum, not shown. The vacuum chamber 27 is connected to a series of equally spaced grooves 30.

The female die 20 is provided with a heat exchange chamber 34 into which a heat exchange medium, such as steam, hot oil or the like, can be introduced through inlet 35 and withdrawn through outlet 36.

The structure described is mounted in a press in any suitable manner so that the dies 19 and 20 can be brought together under pressure with the felted article 37 between them. The male die 19 is provided with the above described series of equally spaced grooves 30, illustrated in cross section, which both permits the water removed from the drying article 37 to drain into vacuum chamber 27 and which imparts a pattern of equally spaced longitudinal ridges to be formed on the inside surface of the molded fiber product or casing.

The female die is solid and is preferably chrome plated, thereby giving the finished article a smooth outer surface.

Figure 2:
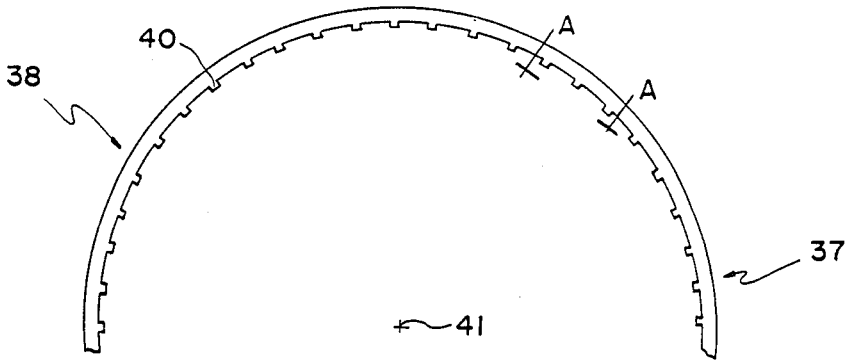
FIG. 2 is a transverse cross-sectional view of a portion of a shell casing formed by the method of the present invention.

In the instant invention, it has been found that the removal of protective screens from the drainage grooves on male die 19 of a prior art die and an increase in the number of grooves 30 rather than being a deficiency actually provides a unique intermediate product or article. When the drainage grooves 30 are free to contact the fiber preform product, a molded fiber article such as that shown in cross-section in FIG. 2 is produced. This article consists of a cylindrical shell casing wall 38 having ridges 40.

While these ridges 40 are indicated on the interior side of cylinder shell 38, it is contemplated that these ridges may be alternatively located only on the outside or on both the inside and outside of the product. Furthermore, in the preferred embodiment, these ridges 40 run longitudinally along the casing and are generally parallel to the longitudinal axis 41 of the casing (as shown in FIG. 2) or for other products they may run in any other direction. For instance, these ridges may be arranged perpendicularly to the disclosed ridges and accordingly encircle longitudinal axis 41 to permit the shaping or deformation of a molded fiber product by the use of suitable pressure producing tools.

It is preferable that the male die contain the drainage grooves. These grooves, in an increased number than ordinarily used on a male die, will create the uniformly spaced ridges of the present invention.

Figure 3:
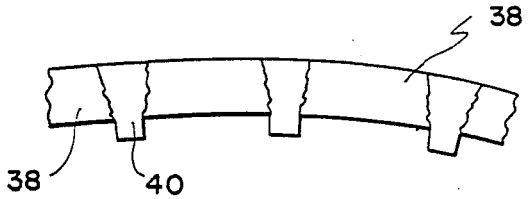
FIG. 3 is a cross-sectional view of FIG. 2 taken along lines AA showing a portion of the shell casing.

As seen in FIG. 3, a cross-sectional view of a segment AA of the casing is indicated. The ridges 40 consist of an area of reduced density in the compressed cylinder wall 38. The density of the molded fiber product in the fully compressed cylinder wall has a target value of 1.1 grams per cc. However, this will vary with the weight of the wet preform being die dried. In any case, however, the ridges will be of lower density, and thus permit the swaging of this invention. Ideally, the compressed areas 39 of the compressed deformable molded fiber product will have an overall density of 1.1 grams per cubic centimeter.

It has been found that the uniformly spaced ridges should be located between 5° on center and 10° on center to create the properly deformable intermediate product. A particular advantage of this product is that the product can be molded closed at one end and subsequently have a reduced diameter formed at the open end.

The ridges of this invention are of different dimensions than those ordinarily formed when the use of protective screens is omitted from a prior art standard die. The ridges of this invention are of between 0.050 inches to 0.060 inches wide and approximately 0.040 inches high. At a spacing of ridges 10° on center it is preferred that the ridges be 0.050 inches wide and 0.040 inches high. At a spacing of 5° on center, it is preferred that the ridges be 0.060 inches wide by 0.040 inches high.

A spacing of approximately 10° on center produces a product reaching the outer limits of deformability. A spacing of substantially more than 10° on center increases the risk of fracturing, stripping or otherwise damaging the formed molded fiber product. At a spacing of under 5° on center the product also has a high risk of crumbling or not remaining stable. The most preferred spacing of ridges is between 5° and 7.5° on center. These ridge areas 40 of a reduced density permit the swaging like technique of the present invention.

During this swaging process, the areas 40 of low density become compressed and approach the density of the surrounding material 38. The low density ridges remaining in the non- compressed areas of the molded fiber product do not affect the overall performance of the product.

FELTING FIBER FOR A PREFORM

The formation of the product of this invention will now be described in greater detail. Generally the felted preform which is the first step in this invention is formed in a pulp molding process well known in the art. The preferred process of adding the binding polymer to the fiber is known as a beater treatment and is described generally in Chapter 7 Pulp Molding, Industrial and Specialty Papers Vol. IV, Product Development, Chemical Publishing Co., 1970, and in Molded Fiber Products, pgs. 3090–92, DeLuca & Williams, Encyclopedia of Materials Science and Engineering, Pergamon Press, 1986.

In the process, cellulose fibers are slurried in water and beaten, a polymer resin dispersion is added along with other stabilizing and treating agents. This mixture is fed into a felting tank, and the fibers are vacuum accreted onto a porous shaped preformer to produce a wet felted preform casing. This felted preform casing is pressed and die dried in the dies set forth above.

Stock preparation for the process involves three tanks as is well described in the prior art. In the first tank, the fibers are slurried and dispersed in water. They may be cycled through a deflaker/Jordan to increase the degree of fibrillation. In the second tank, the various fibers are assembled and treated with a polymer resin dispersion. In the successful procedures, the polymer resins are caused to be absorbed onto the fibers by the addition of a cationic resin and to stay with them during the felting and drying steps where they act to bind the fibers together. In a third tank, the prepared slurry is diluted to the proper felting consistency, around 0.2%, and used to supply the felting tank.

The fibers employed in the method of this invention are nitrocellulose fibers, cellulose fibers, such as Southern Kraft, and synthetic fibers. Unrefined wood fibers containing both cellulose and lignin are also used. In addition, mixtures of these materials may be used. The nitrocellulose fiber must be calculated as part of the propellant charge of the final shell product.

The previously described types of polymer resins are anionic dispersions/emulsions that are deposited on the fibers by the addition of a small amount of a cationic material such as described in U.S. Pat. No. 3,406,139 which removes the anionic charges and allows fibers and resins to associate in response to Van der Wall's forces. High molecular weight polyvinyl acetate emulsion added to the fiber by use of a quaternary epoxy polyamide works well in the process. Copolymers or grafted copolymers of acrylonitrile butadiene and styrene also give desired results. These ABS polymer emulsions are often dispersed by rosin soap and are precipitated on the fiber by the addition of Alum to the slurry. The rosin acts as a tackifier to the polymer and assists in the deposition of the polymer on the fiber.

When the slurry is diluted in the third tank, the concentration of cationic resin is between 0.2 to 2% and the thermoplastic polymeric resin emulsion/dispersion up as high as 20%, all based on the weight of cellulose fiber.

The upper limit on addition of polymer will be where the felted preform casing seals off, blisters and refuses to dry. The lower limit is where the swaged die dried part does not rebind itself as the drainage groove marks are compressed. Accordingly, the acceptable range is between 5 to 20% thermoplastic polymer resin. However, these figures will be influenced by the polymer type.

In summary, polymers useful in this invention must have certain properties. It is important that these polymers become plastic at or below 240° F. so that the part may be reshaped and fibers rebonded by the application of heat and pressure. With nitrocellulose fibers, temperatures during reshaping should not exceed 250° F. High molecular weight polymers are also preferred as they possess strength while hot. Furthermore, it is necessary that the polymers be thermoplastic during the swaging and detent forming operations. Further, these polymers should be hard or non-plastic at temperatures usually encountered by humans and their military equipment that is a temperature below 150° F.

The cationic resins are used up to 2% of the fiber and resin in the beater treating formulas and are preferably used at ½ to 1%. These resins include methylol melamines, quaternary epoxy amides, polyethyleneimine and polyvinyl imidazoline. Other cationic resins are available. Aluminum sulfate can be added to bring the pH of the slurried fibers down to 4.5. The aluminum sulfate gives a very positive cationic effect and can be used even when the organic cations are present.

The following specific example is given by way of illustration.

EXAMPLE 1

120 mm shell casings are made by felting a preform on the 120 mm preformer from a nitrocellulose propellant slurry made to formulations well known to persons working with propellants and munitions, such as but not limited to U.S. Pat. Nos. 3,474,702 or 2,991,168. Such formulations usually contain between 50–70% nitrocellulose fiber and 15–40% other cellulose fibers as well as stabilizers and polymers as discussed previously.

After felting, the preform casing is removed from the preforming die by a blast of air and placed on the male die. Then the male and female dies are closed as shown in FIG. 1 and the preform 37 is dried for approximately 5 minutes at 235° F.

Subsequently, the molded fiber product 37 is mounted in the swaging tool 46 shown in FIG. 5 and the open end of the product 44 is swaged by forcing the product into the heated swaging die 50 to form a reduced diameter as described later in detail. The product is removed from the swaging tool and mounted in the button or detent forming tool illustrated in FIGS. 7 and 8. A detent is formed by hot pressing as described in detail below.

Swaging Operation

After the formed product is removed from the die-drying press, it is swaged. Swaging is a metal working term used to describe a process where a tube or rod is forced into a confining die to reduce its diameter. It also includes forcing a tube onto a flaring tool to widen or spread the tube.

The usual die-dried molded fiber product has side walls which are not flexible and will tear or fold if any attempt is made to spread or decrease the diameter of the casing. However, it has been found that the uniformly spaced lower density ridges formed on the product of the present invention provides sufficient flexibility to the heated product to permit a form of swaging akin to the metal working technique because these ridges are of lower density and can be compressed until they equal the density of the adjacent wall by the modified swaging operation of this invention in the special swaging tool of this invention. After swaging, the fiber is rebonded as the thermoplastic resin cools and again becomes hard.

Figure 4:
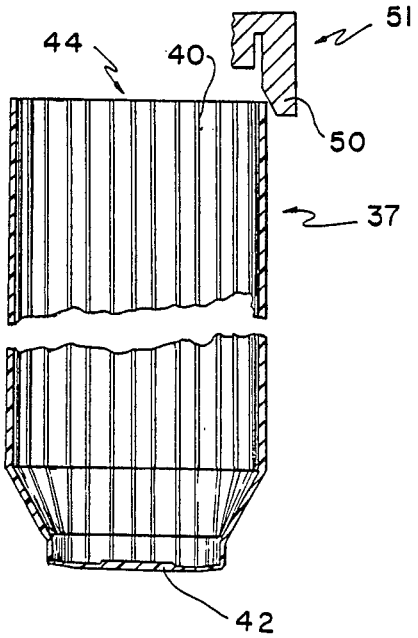
FIG. 4 is vertical longitudinal sectional view of a shell casing formed by the method of the present invention before swaging showing the position of a portion of the swaging die.

As seen in FIG. 4, a longitudinal cross-section of the molded fiber product preform as shown in cross-section in FIG. 2 is disclosed. This product 37 having a wall section 38 of maximum density has a forward or substantially closed end 42 and an open or rearward end 44. The ridges 40 are in the inside surface. A portion 50 of the swaging die 51 is shown in FIG. 4 as it is about to contact the product 37.

Figure 5:
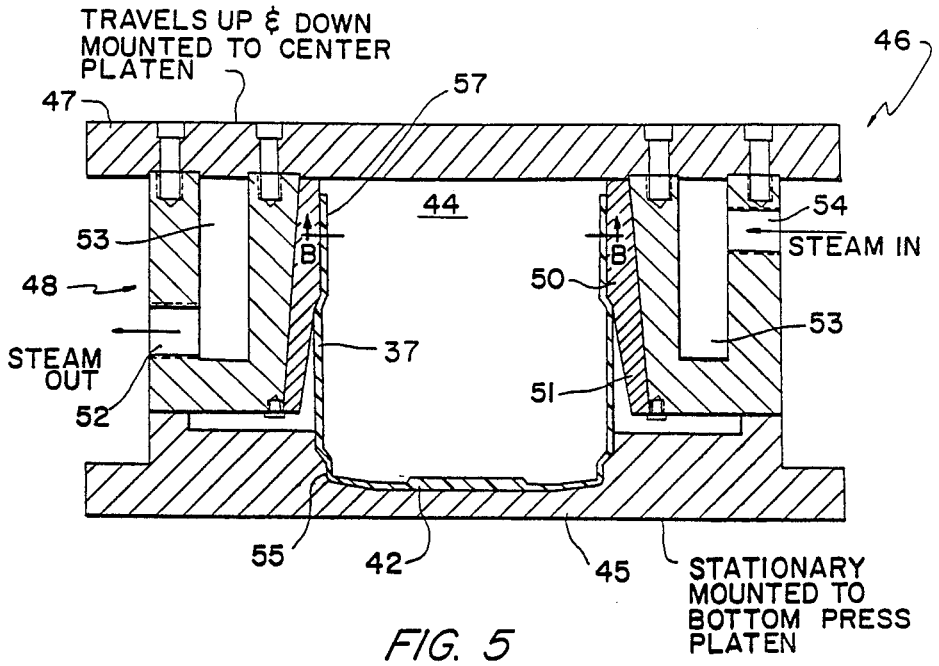
FIG. 5 is longitudinal cross-sectional view of the swaging tool of the present invention showing a swaged product of the present invention.

As shown in FIG. 5, the molded product 37 is placed in the swaging tool marked generally 46 with its open end 44 against the tapered reduced diameter 50 of the swaging die 51. The swaging tool 46 comprises the die 51, its support 48, its heating chambers 53, support or base 45, mounted on the platen of a standard press, and a means of applying pressure to the plate 47 of die support structure 48. The standard press is not illustrated.

The swaging tool is heated to a temperature not exceeding 250° F. The die 51 is heated by a means similar to that used to heat the die-drying molds illustrated in FIG. 1. A fluid such as steam or hot oil flows in through port 54 to chamber 53 which circumferentially surrounds the swaging die 51. The heated fluid is removed through exit port 52. A base 45, preferably with a depression 55 shaped like the closed end of 42 of the product being swaged, is placed on the platen of a press. The product 37 is placed in the depression 55 with its open end 44 facing upward.

The die support 48 containing the die 51 is mounted to the traveling center platen in a standard two or four poster down-acting press.

Die 51 is brought down and worked against the product 37 at a rate slow enough to allow softening of the thermoplastic resins. Preferably, the die 51 moves at a rate of approximately 5 millimeters per second. The swaging die is heated at an appropriate temperature for working with nitrocellulose, preferably at or just below 250° F. The slow action of the press allows the thermoplastic polymer resins, to soften causing the open end 44 of the product 37 to assume the shape of the narrowing portion 50 of the swaging die 51. If a more rapid movement were carried out, the product 37 may buckle and deform.

Figure 6:
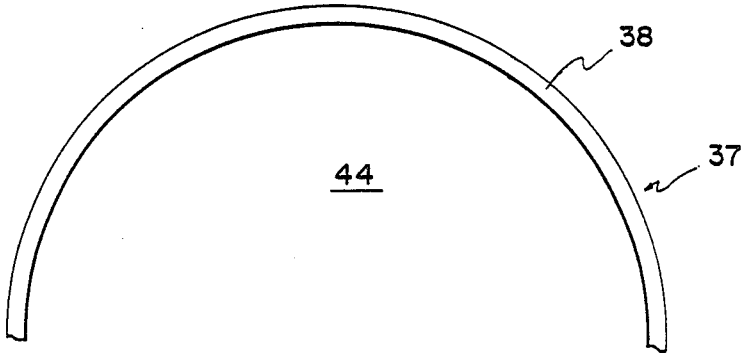
FIG. 6 is a transverse cross-sectional view of the swaged portion of a product of the present invention taken along lines BB of FIG. 5 with the swaging tool removed for clarity.

After the reduced diameter is formed, the product 37 is removed from the swaging tool 46 and allowed to cool. It is noted that the ridges (reduced density areas 40 of FIG. 2) on the interior of product 37 are no longer present in the swaged area as is illustrated in FIG. 6. The swaging tool has effectively compressed these ridges to approximately the same density as wall 38. The excess material gathered in the swaging operation is actually compacted within itself. Thus, this swaging operation fundamentally differs from metal working operations.

Figure 9:
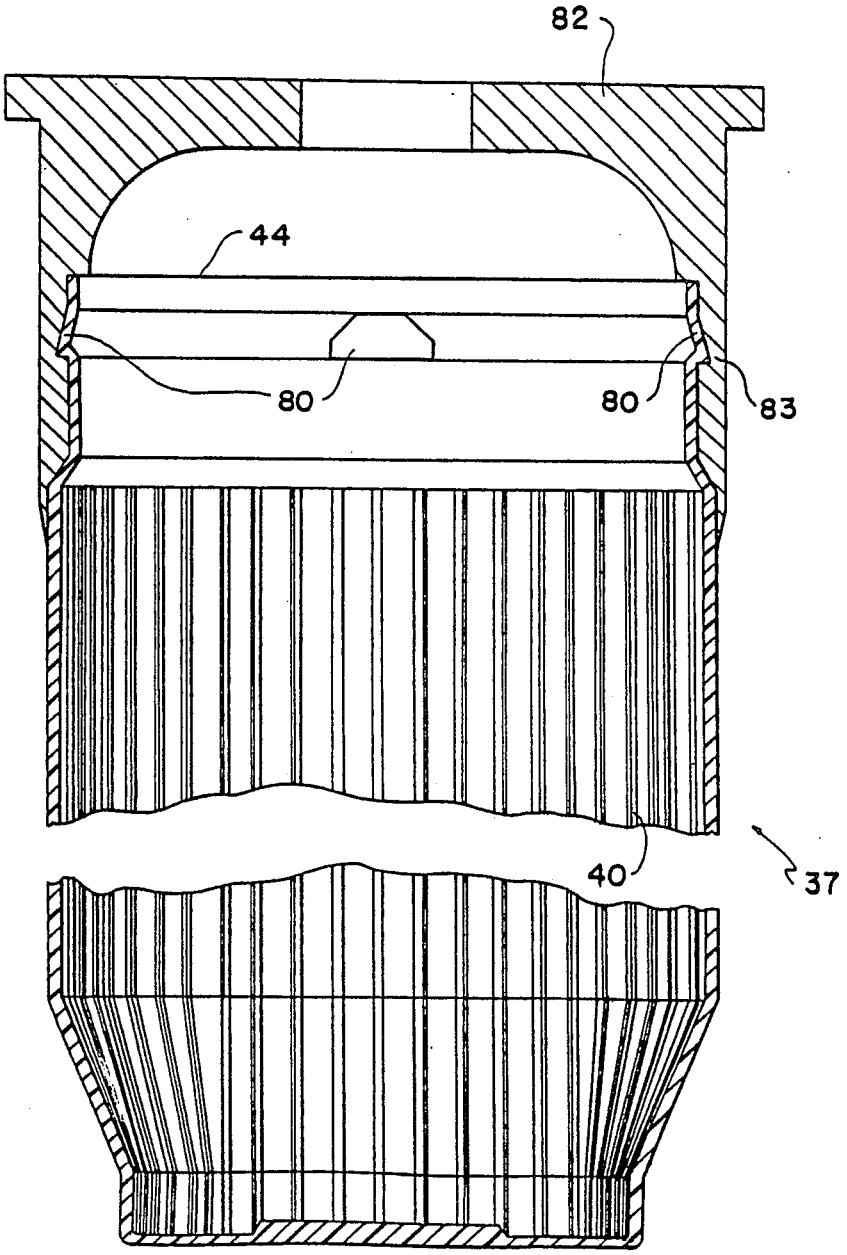
FIG. 9 is a longitudinal cross-sectional view of a shell casing of the present invention showing a metal base attached to the casing.

Accordingly, the increased number of grooves 30 of the male drying die 19 of this invention has a function apart from the normal removal of water and steam during drying. These grooves produce ridges (low density areas 40) which create a unique deformable product. These ridges 40 permit the swaging of a molded fiber product 37. While FIG. 6 only indicates the swaged portion of product 37 acted upon by swaging tool 46, it is noted that the ridges would remain in the mid and forward sections of the product 37 which are not acted upon by swaging tool 46 as is illustrated in FIG. 9.

Detent Forming Operation

Figure 7:
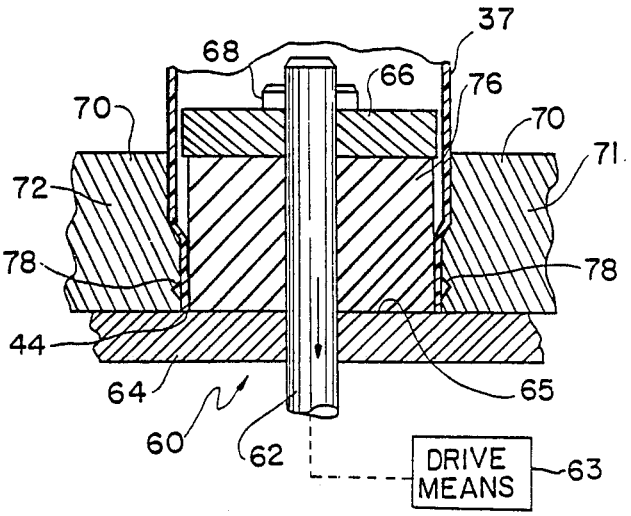
FIG. 7 is a longitudinal cross-sectional view of the shell casing of the present invention inserted in a detent forming tool of the instance invention.

After product 37 has been swaged, it then may be inserted into a detent forming device 60 as indicated in FIG. 7. This device forms detents or buttons on the product 37 to provide a means of attaching a stub base. The detent device 60 comprises healed split female die 70, two pressure plates, 64 and 66, and a drive shaft 62. The plate 64 may be the bench or work surface.

In operation, the open swaged end 44 of the product 37 is inserted into the split die 70 of device 60. A fixed plate or bench top 64 having a greater diameter than the diameter of the product 37 contains a central aperture for receiving vertically adjustable shaft 62. A drive means 63 is provided for reciprocating the shaft 62 as will be described in more detail below. On the end of shaft 62, a plate holding means 68 is provided. A movable plate 66 is received on shaft 62. The positioning of this plate 66 is fixed relative to shaft 62 by plate holding means 68. A resilient, deformable material 76 is encompassed between the plate 66 and the face 65 of fixed plate 64.

The diameters of the plate 66 and resilient means 76 are slightly less than the internal diameter of the product 37. The thickness of the plate and the resilient means is not critical, but the resilient means should be thick enough to deform under compression.

Split die 70 has at least one and preferably several recesses, indentations or patterns 78 on its inside surface. The indentations may be a continuous indentation about the circumference of the die or several button like indentations. In the preferred embodiment four indentations are used. Each of these indentations is located about a quarter of the way around the periphery of the side of die 70. These indentations 78 form the cavities which will create the detents on the casing 37.

Figure 8:
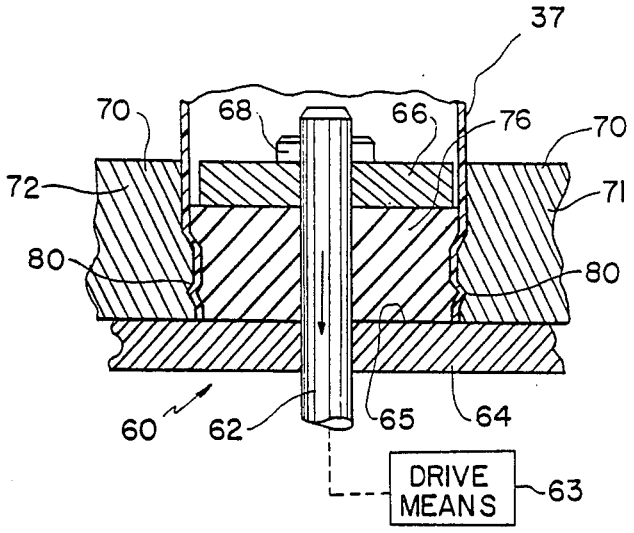
FIG. 8 is a view similar to FIG. 7 of the present invention after formation of the detent on the shell casing but before removal of the tool.

To form a detent, drive means 63 pulls movable plate 66 towards fixed plate 64. This action causes resilient means 76 to bulge outwardly. This resilient means is preferably 40–50 shore durometer neoprene. In compression, this rubber deforms, outwardly forcing the molded wall against the die 70 and into cavity 78 thereby forming the detent. It is necessary to heat the split die 70 to a temperature not to exceed 250° F. to facilitate the detent formation. FIG. 8 illustrates the formed detent 80.

In order to remove the product 37 having the formed detents 80, side panels 71 & 72, of the die 70 are opened and the product 37 removed. The molded product 37 may then be pulled from tool 70.

It is contemplated that this device 60 would be suitable for use with other molded fiber products which have not been swaged or which do not contain ridges (reduced density areas 40).

As seen in FIG. 9, the open end 44 of product 37 is now equipped to snap fit to a suitably arranged stub base 82 to obtain the desired structure. This product 37 is attached to the metal stub base 82 by means of casing detents 80. The suitable stub base has a radial groove receiver machined into the area 83 to receive detents 80. The combustible product 37 is inserted onto the stub base 82 by merely applying downward pressure thereon. This arrangement provides for an economical and convenient method for applying the one-piece shell product to the metal stub base 82.

This arrangement obviates the need for two moldings used in the prior art and allows considerable material and labor savings. This invention also permits a fully combustible shell casing to have its igniter cup section or base mechanically attached in the same manner, making a clean and streamline mechanical joint. This arrangement requires less tooling and therefore can reduce the required floor space for machines for producing the shell casings.

From the invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What we claim is:

1. A method of forming a deformable, molded fiber product comprising the steps of, vacuum accreting a preform from slurried fibers comprising a mixture of fibers and at least one thermoplastic resin normally hard and having a softening point less than the degradation point of the most flammable fiber in the slurry, pressing said preform in a mold assembly, said mold assembly having uniformly spaced parallel grooves in a surface which contacts the preform, to form a molded fiber product, the grooves in said mold assembly forming uniformly spaced ridges on at least one surface of said product, said ridges constituting areas of low density, and drying said product to form said deformable molded fiber product, said ridges being sufficient in number to permit deformation of said deformable product without destruction of said product.

2. A method according to claim 1 wherein said fibers comprise nitrocellulose fiber and a fiber selected from the group consisting of natural cellulose fiber, synthetic cellulose fiber and mixtures thereof.

3. A method according to claim 2 wherein said product is open at one end and closed at the opposite end.

4. A method according to claim 2 wherein said uniformly spaced ridges extend parallel to a longitudinal axis of the product and are located between 5 degrees on center and 10 degrees on center.

5. A method according to claim 3 wherein said uniformly spaced ridges extend parallel to a longitudinal axis of the product and are located between 5 degrees on center and 10 degrees on center.

6. A method according to claim 5 wherein said ridges are between 0.050 inches to 0.060 inches wide.

7. A method according to claim 5 wherein the ridges are up to about 0.040 inches high.

8. A method according to claim 6 wherein said ridges are up to about 0.040 inches.

9. A method according to claim 3 wherein said ridges extend parallel to a longitudinal axis of the product and are located at 7½ degrees on center.

10. A method according to claim 3 wherein said ridges extend parallel to a longitudinal axis of the product and are located at 5 degrees on center and are about 0.06 inches wide and about 0.040 inches high.

11. A product formed by the method of claim 4

12. A product formed by the method of claim 6.

13. A product formed by the method of claim 9.

14. A product formed by the method of claim 10.

15. A method in which a die dried pulp molding is swaged into shapes difficult to mold in rigid dies comprising the steps of:

vacuum accreting a preform from slurried fibers on which at least one thermoplastic resin, normally hard at temperatures to about 150 degrees Fahrenheit and having a softening point less than the degradation temperature of the most flammable fiber in the slurry, has been deposited; and drying the preform at 5 to 250 psi in heated rigid dies to create the molding, one of which carries uniformly spaced longitudinal grooves, and connected to vacuum to carry off steam and water, the said grooves producing protuberant parallel ridges in the molding which are of lower density than the more thoroughly pressed portions;

heating the molding to soften the thermoplastic binder; and applying a swaging tool to the molding to swage the same by compressing the low density ridges together and allowing them to be densified, thus increasing the strength of the molding and reducing the dimensions of the molding at the swaged portion.

16. A method according to claim 15 wherein said ridges are located between 5 degrees on center and 10 degrees on center.

17. A method according to claim 16 wherein said ridges are beteen 0.050 inches to 0.060 inches wide.

18. A method according to claim 17 wherein said ridges are 0.040 inches high.

19. A method according to claim 15 wherein said open end of said deformable product is forced into said swaging die at a rate of 5 mm/sec.

20. A method according to claim 15 wherein said swaging form is heated to a temperature not greater than 250° F.

21. A method according to claim 19 wherein said swaging die is heated to a temperature less than 250° F.

22. A method according to claim 18 wherein at least one of said open end of said deformable product is forced into said swaging die at a rate of 5 mm/sec. and said swaging form is heated to a temperature above the softening point of said thermoset resin and below 250° F.

23. A method according to claim 22 wherein said ridges are locaed 5 degrees on center.

24. A method according to claim 22 wherein said ridges are located 7½ degrees on center.

25. A method according to claim 22 wherein said ridges are located 10 degrees on center.

26. A product formed by the method of claim 23.

27. A product formed by the method of claim 24.

28. A product formed by the method of claim 25.

29. A method of forming a combustible shell casing comprising the steps of:

vacuum accreting a preform from a slurry containing nitrocellulose and other fibers on which thermoplastic resins have been deposited, at least one of the resins being normally hard at temperatures to about 150 degrees Fahrenheit and having a softening point less than the degradation temperature of the nitrocellulose;

pressing and drying the perform in dies shaped to form a molding open at least at one end and having uniformly spaced longitudinal ridges on the inner surface, said ridges being of reduced density formed at substantilly 10 degree centers and at less than 10 degree centers;

bringing the portion of the molding to be deformed into a semiplastic condition and subsequently forcing this portion into a swaging die to produce a reduced dimension along a predetermined length of the molding;

removing the deformed molding from the swaging die, and again, while the composition has been brought to a semiplastic state, subsequently forming at least one detent about the circumference of the reduced dimension; and fitting a metal stub base to the detent to close the open end of the molding to form said shell casing.

30. A method in which a die dried pulp molding is swaged into shapes difficult to mold in rigid dies comprising the steps of:

vacuum accreting a preform from slurried fibers on which thermoplastic resins have been deposited, drying the preform in heated mated rigid dies, one of which carries grooves connected to vacuum to carry off water and steam, the said grooves producing protuberant ridges in the molding which are of lower density than the more thoroughly pressed portions;

heating the molding to soften the thermoplastic binder; and applying a swaging tool to the perform to swage the same by compressing the low density ridges together and allowing them to be densified, thus increasing the strength of the molding and reducing the dimensions of the molding at the swaged portion.

* * * * *